US005638765A

United States Patent [19]

Poulos

[11] Patent Number: 5,638,765

[45] Date of Patent: Jun. 17, 1997

[54] HYDROFOIL ASSEMBLY FOR MARINE USE, AND METHOD FOR MOUNTING THE SAME

[76] Inventor: John George Poulos, 125 Lincoln Ave., Apt. B4A, Mineola, N.Y. 11501

[21] Appl. No.: 349,122

[22] Filed: Nov. 30, 1994

Related U.S. Application Data

[63] Continuation of Ser. No. 96,709, Jul. 23, 1993, abandoned, which is a continuation-in-part of Ser. No. 773,678, Oct. 7, 1991, Pat. No. 5,231,950.

[51] Int. Cl.[6] ..... B63B 1/24

[52] U.S. Cl. ..... 114/274; 114/280; 440/51

[58] Field of Search ..... 114/274, 275, 114/276, 277, 278, 280, 281, 126; 440/51, 66, 67, 71, 72, 900

[56] References Cited

U.S. PATENT DOCUMENTS

| | | | |
|---|---|---|---|
| 3,285,219 | 11/1966 | Linsley | 440/51 |
| 3,991,700 | 11/1976 | Cleary et al. | 440/51 |
| 4,977,847 | 12/1990 | Bartlett | 114/274 |
| 4,995,840 | 2/1991 | Seale et al. | 440/66 |
| 5,048,449 | 9/1991 | Templeman | 114/274 |
| 5,138,966 | 8/1992 | Whitley | 114/274 |
| 5,231,950 | 8/1993 | Poulos | 114/274 |

*Primary Examiner*—Stephen Avila
*Attorney, Agent, or Firm*—Hoffmann & Baron

[57] ABSTRACT

A method and an assembly are provided for mounting a pair of hydrofoils to an outboard engine without drilling holes or otherwise defacing the anticavitation plate of the engine. The assembly includes a mounting plate, an adaptor, and a pair of hydrofoils. The hydrofoils are mountable to the outer edge portions of the mounting plate. In use, the counter-rotation tab of the engine is removed and then replaced by the adaptor. The mounting plate, if not already secured to the adaptor, is coupled to the adaptor. The hydrofoils are then mounted to the opposing edges of the mounting plate. A pair of reinforcing brackets may be secured to the mounting plate such that they extend over the edge portions of the cavitation plate. The forces generated upon the mounting plate will accordingly be distributed to the anti-cavitation plate as well as the adaptor. The hydrofoils employed in the assembly preferably include rudders, which obviate the need for the counter-rotation tab replaced by the adaptor. In the event the hydrofoils do not include such rudders, a fin assembly may be mounted to the mounting plate beneath the adaptor. The hydrofoil assembly compensates for propeller torque and provides other benefits in handling a marine vessel.

17 Claims, 12 Drawing Sheets

HYDROFOIL ASSEMBLY FOR MARINE USE, AND METHOD FOR MOUNTING THE SAME

CROSS REFERENCE TO RELATED APPLICATION

This is a continuation of Ser. No. 08/096,709 filed on Jul. 23, 1993, now abandoned, which is a continuation-in-part of application Ser. No. 07/773,678 filed Oct. 7, 1991, now U.S. Pat. No. 5,231,950.

BACKGROUND OF THE INVENTION

1. Field of the Invention

The field of the invention relates to hydrofoil assemblies of the type secured to the lower part of a marine outboard engine or outdrive.

2. Brief Description of the Related Art

Hydrofoils are employed by many boaters for providing faster planing, increased control, and reduced bow rise. Steering response is quickened in most watercraft through the use of such devices, and fuel savings may be obtained.

A number of different hydrofoil designs have been proposed for use with watercraft. U.S. Pat. Nos. 4,995,840, 5,048,449 and 5,138,966 disclose various hydrofoil constructions, all of which are mounted to the anticavitation plate of a vessel when in use.

A hydrofoil having a plurality of torque control rudders is disclosed in copending application Ser. No. 07/773,678 filed Oct. 7, 1991, the disclosure of which is incorporated by reference herein. The hydrofoil includes a recessed edge which is adapted for mounting directly or indirectly to an anticavitation plate. The orientation of the hydrofoil with respect to the motor post can be varied in order to select the amount of torque control being provided by the rudders.

While the hydrofoils described above function acceptably, some boat owners are reluctant to use them as they require drilling holes in the anticavitation plate. People owning brand new boats may be particularly reluctant to drill such holes. A need accordingly exists for allowing boat owners to take advantage of the benefits of hydrofoils without having to deface a portion of their boats.

The anticavitation plates of some engines have edges which are not conducive to receiving the recessed edges of hydrofoils, even if drilled. If such hydrofoils could be mounted to these engines, they too could benefit.

SUMMARY OF THE INVENTION

It is an object of the invention to provide a hydrofoil assembly which is capable of enhancing the performance of a marine vessel.

It is another object of the invention to provide a hydrofoil assembly which may be mounted to a marine outboard engine or outdrive without having to deface the anticavitation plate thereof.

A still further object of the invention is to provide a method for mounting a hydrofoil assembly to the lower part of a marine outboard engine or outdrive in a simple manner without having to drill holes in the anticavitation plate.

In accordance with these and other objects which will be apparent from the detailed disclosure which follows, a hydrofoil assembly is provided which includes a plate having a pair of opposing edge portions, an adaptor securable to the plate, the adaptor being mountable to the lower leg of an engine housing in place of a counter-rotation tab, and a pair of hydrofoils mountable to the outer edge portions of the plate. The leading edge of the plate preferably includes a pair of forwardly extending end portions which define an obtuse angle with respect to each other. The outer edge portions of the plate are preferably substantially parallel to each other. The hydrofoils include at least one, and preferably a plurality of rudders extending downwardly from the lower surfaces thereof. The hydrofoils may be pivotably mounted to the plate to allow the rudders to be oriented properly to compensate for propeller torque and facilitate steering.

A method is provided for mounting hydrofoils to a marine outboard engine or outdrive without defacing the anticavitation plate thereof. The method includes the steps of providing a mounting plate having a pair of outer edges, an adaptor, and a pair of hydrofoils, removing the counter-rotation tab and replacing it with the adaptor, securing the adaptor and mounting plate to the engine, and mounting the hydrofoils to the outer edges of the mounting plate. The hydrofoils are preferably pivotably mounted to the mounting plate, and preferably do not extend beyond the trailing edge of the anticavitation plate. The adaptor may be integral with the mounting plate or provided as a separate piece. If provided as a separate piece, the adaptor is first secured to the engine in place of the counter-rotation tab, and the mounting plate then secured to the adaptor.

DETAILED DESCRIPTION OF THE INVENTION

A hydrofoil assembly 10 is provided for mounting to the lower leg of a marine outboard engine 12 or outdrive. The terms outboard engine and outdrive are used interchangeably for the purposes of the present application.

Figure 1:
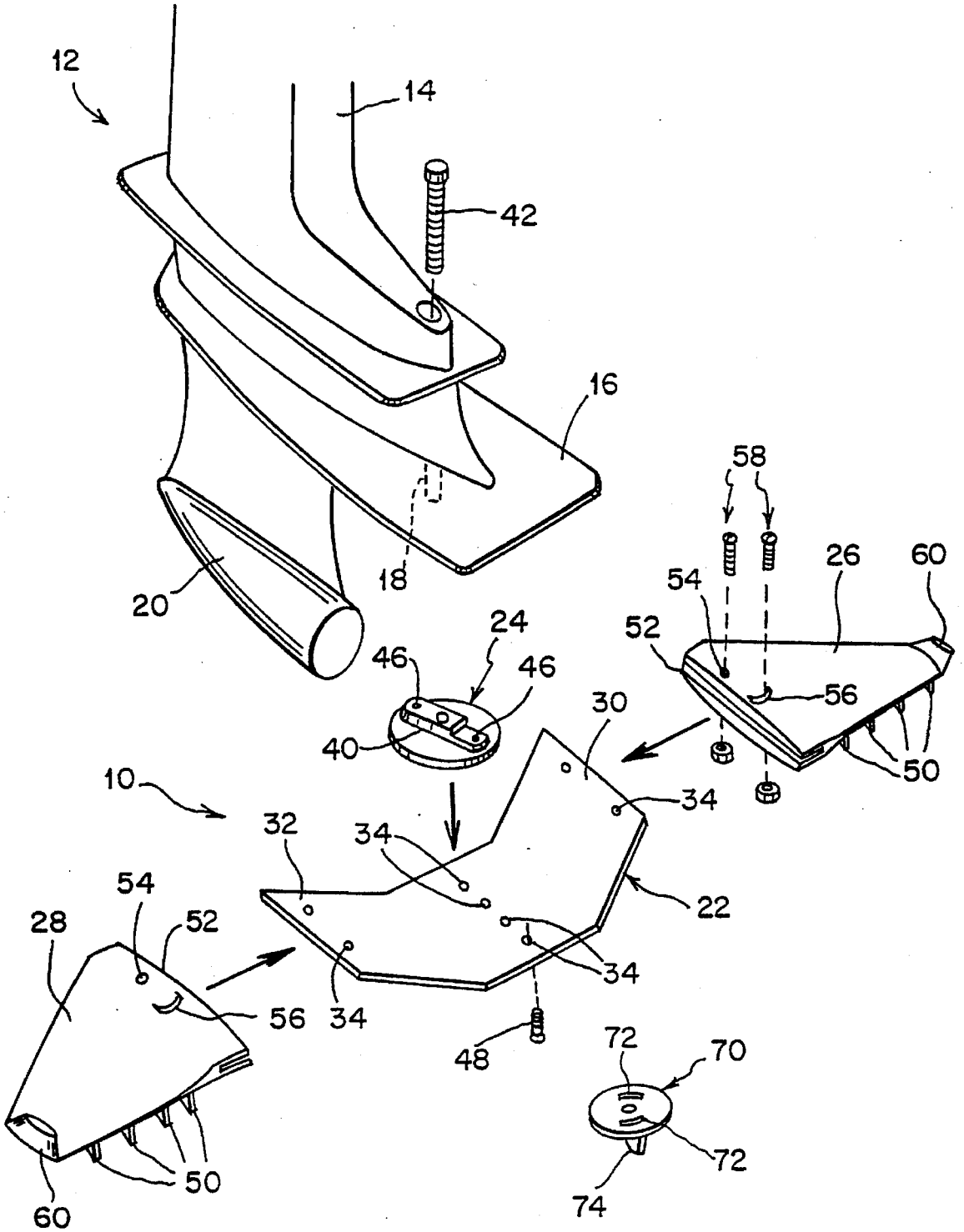
FIG. 1 is an exploded, perspective view of the lower leg of an outboard engine and a hydrofoil assembly securable thereto.
Figure 2:
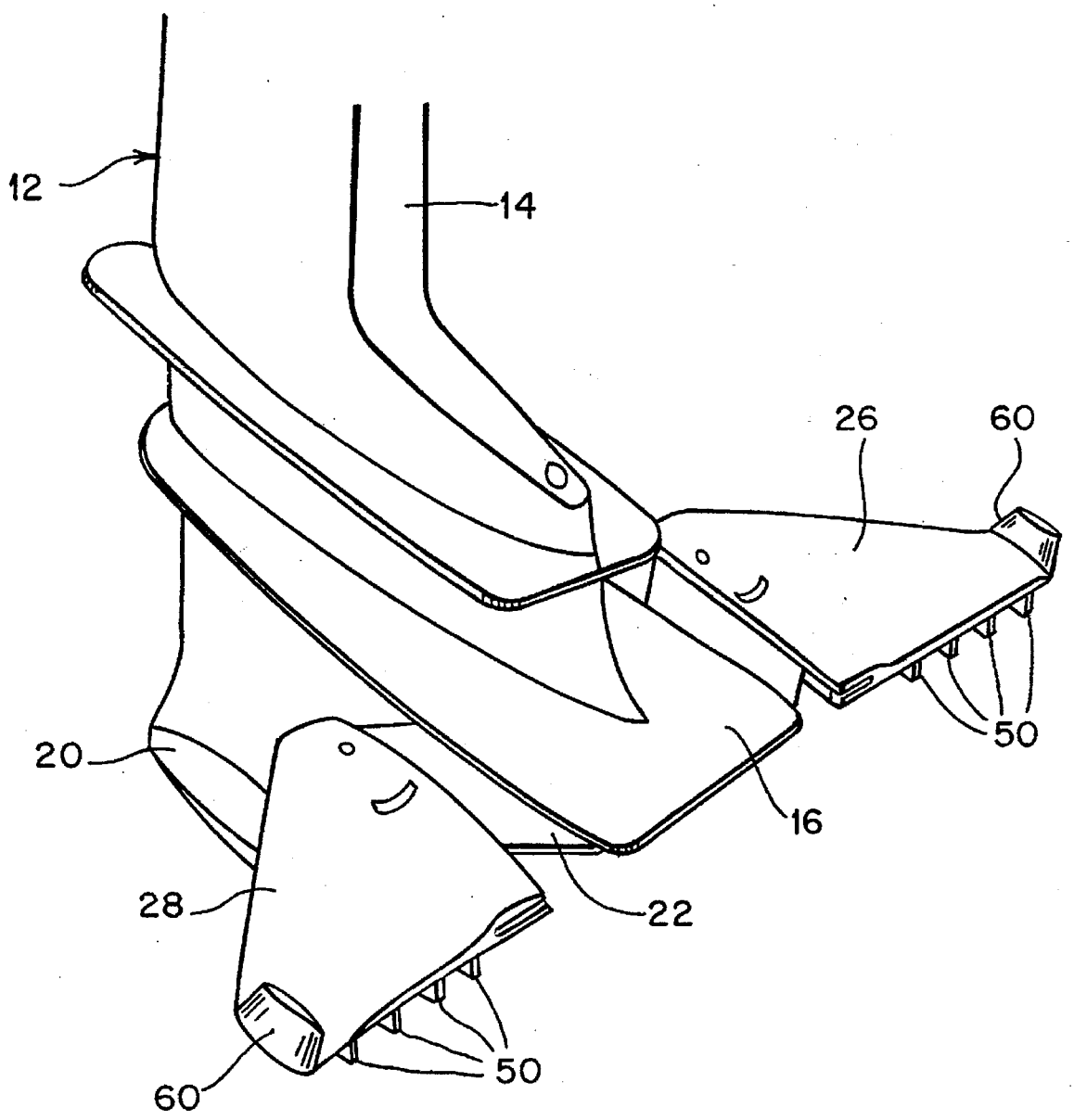
FIG. 2 is a top perspective view showing the hydrofoil assembly of FIG. 1 as mounted to the engine.
Figure 3:
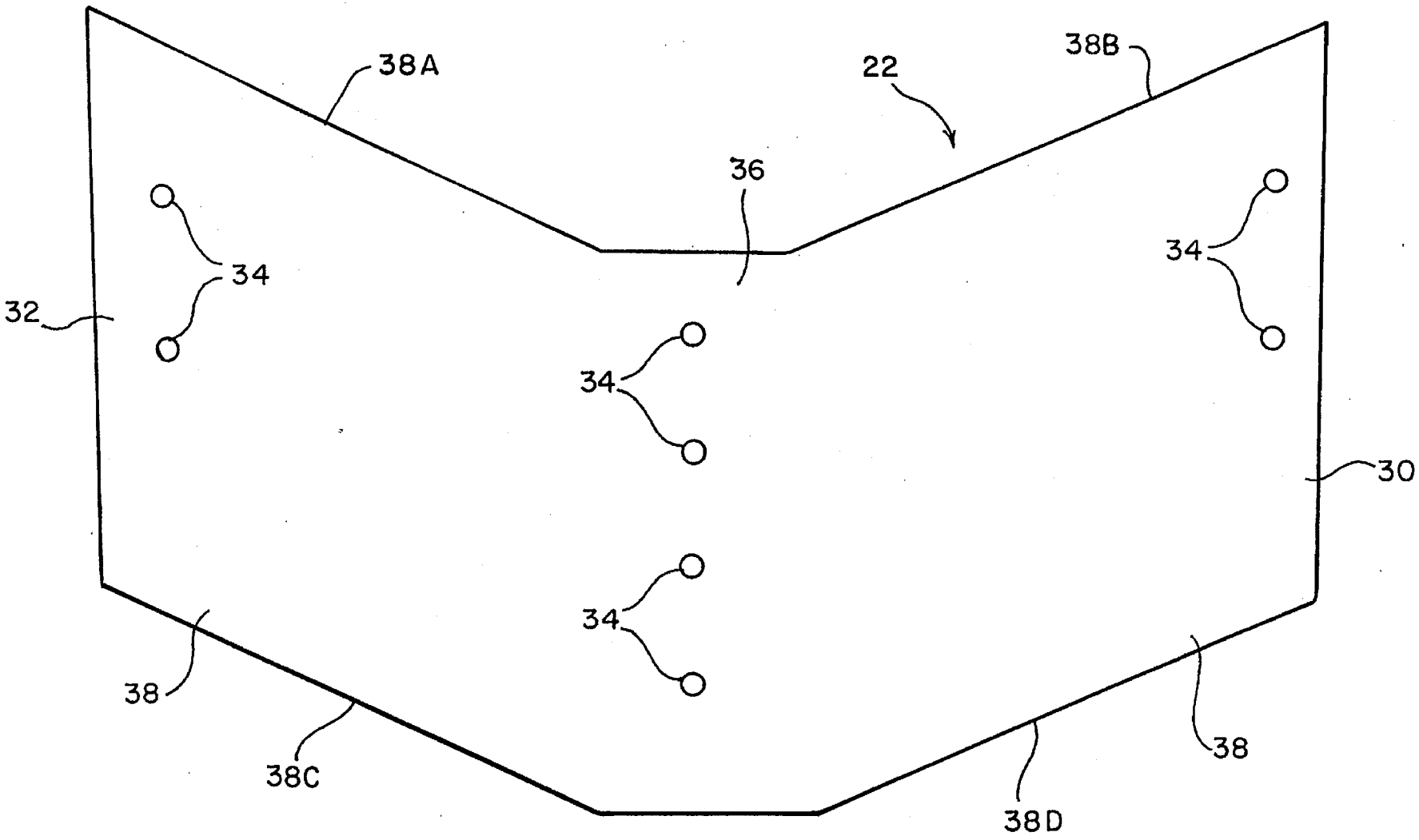
FIG. 3 is a top plan view of the mounting plate of the hydrofoil assembly shown in FIG. 1.

Referring to FIGS. 1–3, the lower leg of a marine outboard engine is shown. The engine includes a motor post 14, an anticavitation plate 16, a counter-rotation tab 18, and a housing 20 to which a propeller (not shown) can be secured. The counter-rotation tab includes a stabilizer fin, and is removably mounted on the propeller side of the anticavitation plate. In some engines, the tab is used for protecting the engine against galvanic action as well as compensating for propeller torque. In others, the tab is employed substantially only for such torque compensation. The hydrofoil assembly shown in FIG. 1 is primarily for those engines which do not employ the tab for protection against galvanic action.

The hydrofoil assembly 10 includes a substantially flat mounting plate 22, an adaptor 24, and a pair of hydrofoils 26,28. The mounting plate 22 in the embodiment of the invention shown in FIGS. 1–3 is preferably made from stainless steel having a thickness of about 0.1875 inches. The plate 22 includes a pair of opposing edge portions 30,32, each of which includes a pair of openings 34 used for mounting the hydrofoils. Four openings 34 are provided along the center line of the plate. These openings allow the mounting plate to be mounted in any of a plurality of positions with respect to the motor post. The end portions of the plate 22 may extend slightly upwardly or downwardly if desired.

As best shown in FIG. 3, the mounting plate includes a central portion 36 and a pair of forwardly extending side portions 38. The leading edge of the mounting plate accordingly includes a pair of forwardly extending portions 38A, 38B defining an obtuse angle with respect to each other. This angle is preferably between about 110–130 degrees. The trailing edge of the plate also includes portions 38C,38D extending at similar angles with respect to each other. The outside edges are substantially parallel to each other.

The preferred size of the mounting plate depends upon the width of the anticavitation plate of the engine with which it is used. A typical width of the mounting plate is about ten to twelve inches, while the length thereof may be about five inches. The width of the central portion may be about two to four inches. The size and configuration of the mounting plate allow it to be mounted to the engine in such a manner that it does not abut the motor post, yet allows the hydrofoils to be properly positioned with respect to the anticavitation plate.

The adaptor 24, like the mounting plate, is made from stainless steel. It may be casted or machined to a configuration required for mounting to an engine in place of the counter-rotation tab 18. The actual configuration of the adaptor depends, of course, on the particular engine to which it will be mounted. The adaptor 24 shown includes a relatively large hole 40 extending axially therethrough for receiving a relatively long threaded bolt 42 extending through the aft portion of the engine. This is the same bolt which formerly retained the counter-rotation tab. The bolt shown in FIG. 2 is top mounted, while those used in some other engines are bottom mounted.

The adaptor further includes a pair of holes 46 on opposing sides of the center hole 40. These holes may be threaded for receiving a pair of threaded bolts, one 48 of which is shown in FIG. 1. The screws extend through two of the openings in the mounting plate and secure the mounting plate to the adaptor. As the mounting plate has four openings along the center line thereof, it may be secured to the adaptor in two different locations. This allows the hydrofoil assembly 10 to be mounted to a number of different engines having different motor posts and anticavitation plates.

The hydrofoils 26,28 employed in the hydrofoil assembly are preferably of the type described in U.S. application Ser. No. 07/773,678 having rudders 50 which extend beneath the plane defining the bottom of the hydrofoil. They further each include a recessed edge portion 52 which receive the edge portions 30,32 of the mounting plate. Each recessed edge portion 52 includes a circular hole 54 and an arcuate slot 56 extending therethrough. These allow the hydrofoils to be pivotably mounted to the mounting plate 22 by nut and bolt assemblies 58. Once the rudders are properly oriented with respect to the propeller to compensate for prop torque, the nut and bolt assemblies are tightened in order to maintain this orientation when the vessel is in use. The rudders 50 obviate the need for the fin or rudder extending from the counter-rotation tab, which is removed prior to installation of the hydrofoil assembly 10. Each hydrofoil further includes a winglet 60 extending upwardly from an end portion thereto to further assist steering.

Figure 8A:
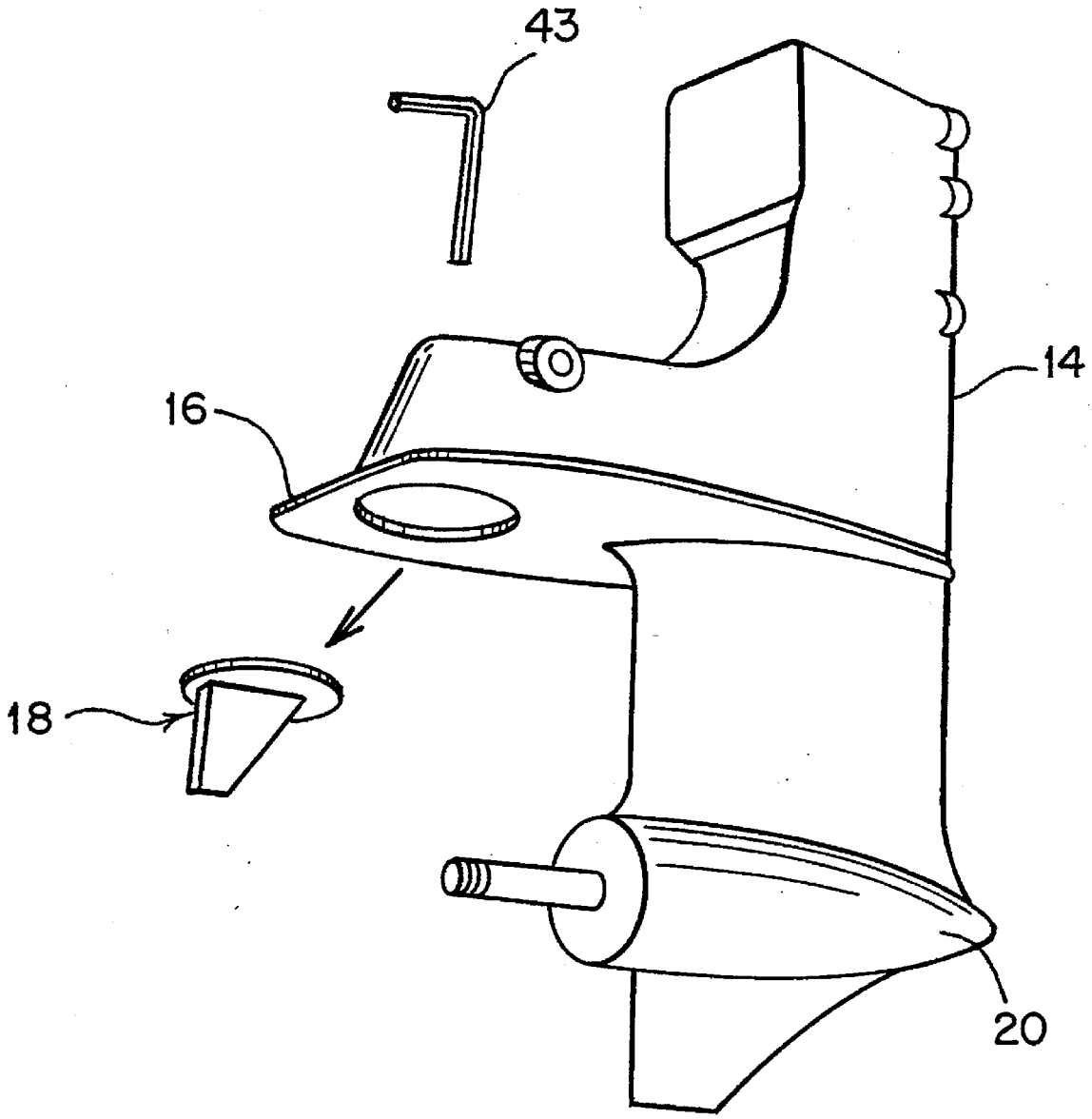
FIGS. 8A–8E show a sequence of steps for mounting a hydrofoil assembly to an outboard engine.
Figure 8B:
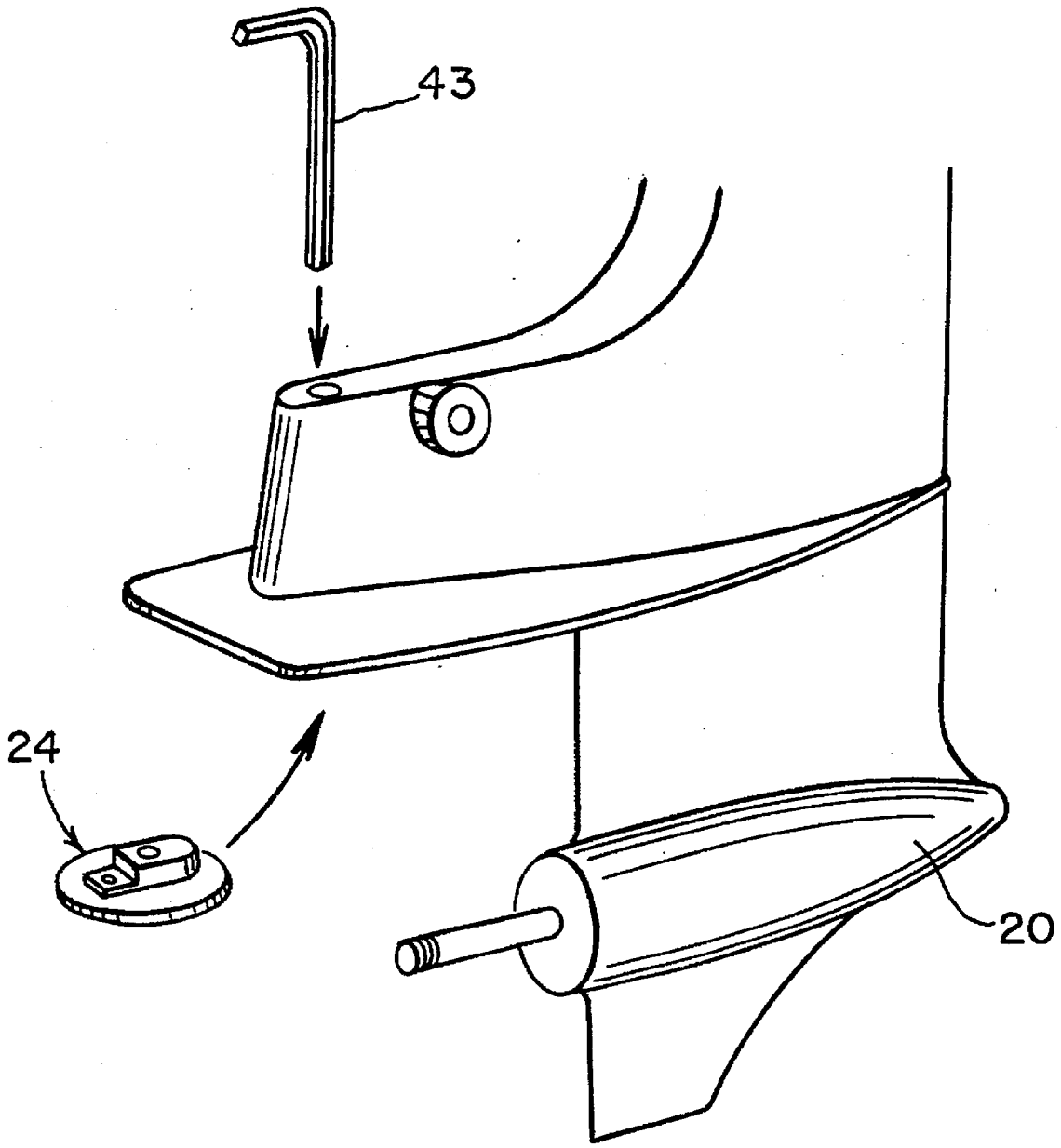
Figure 8C:
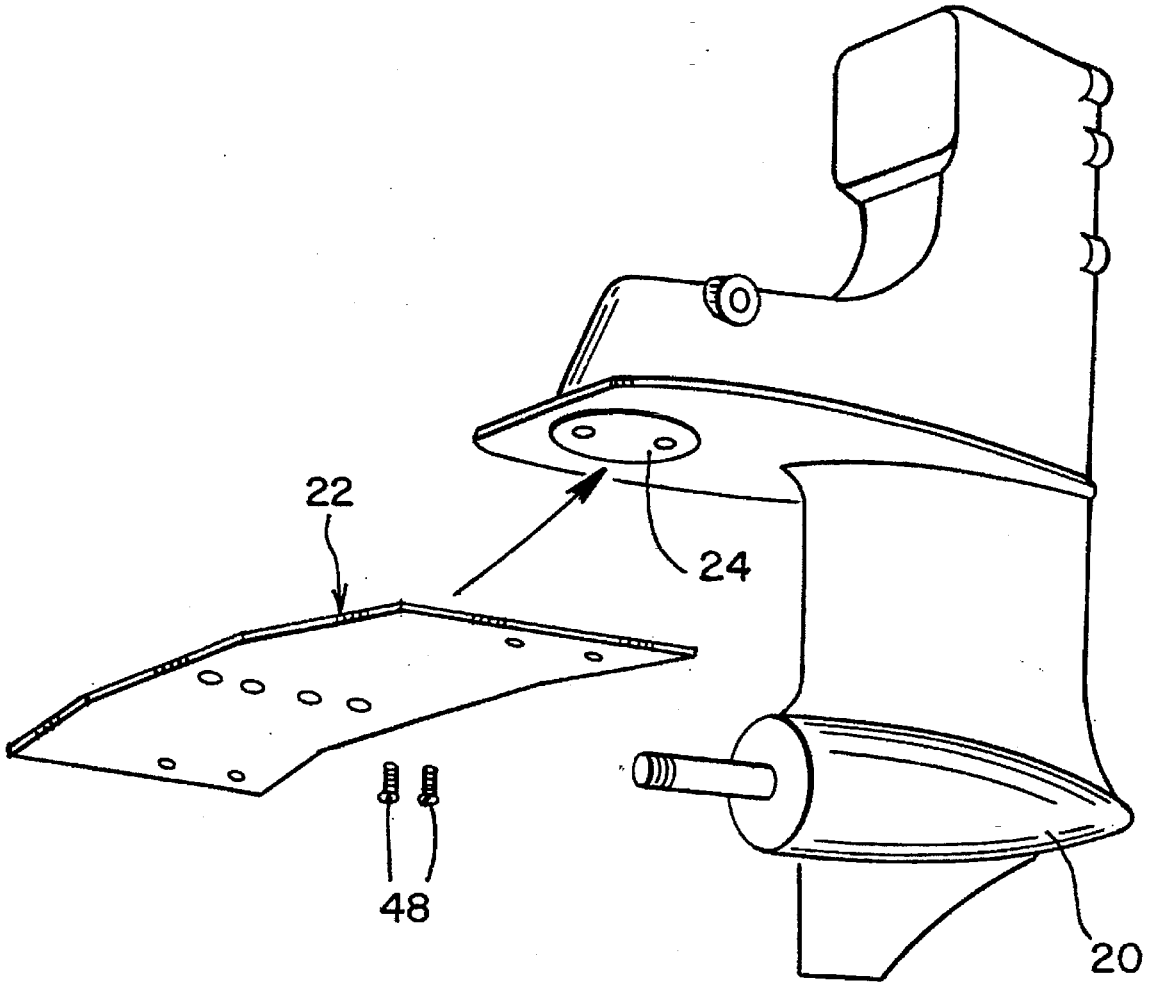
Figure 8D:
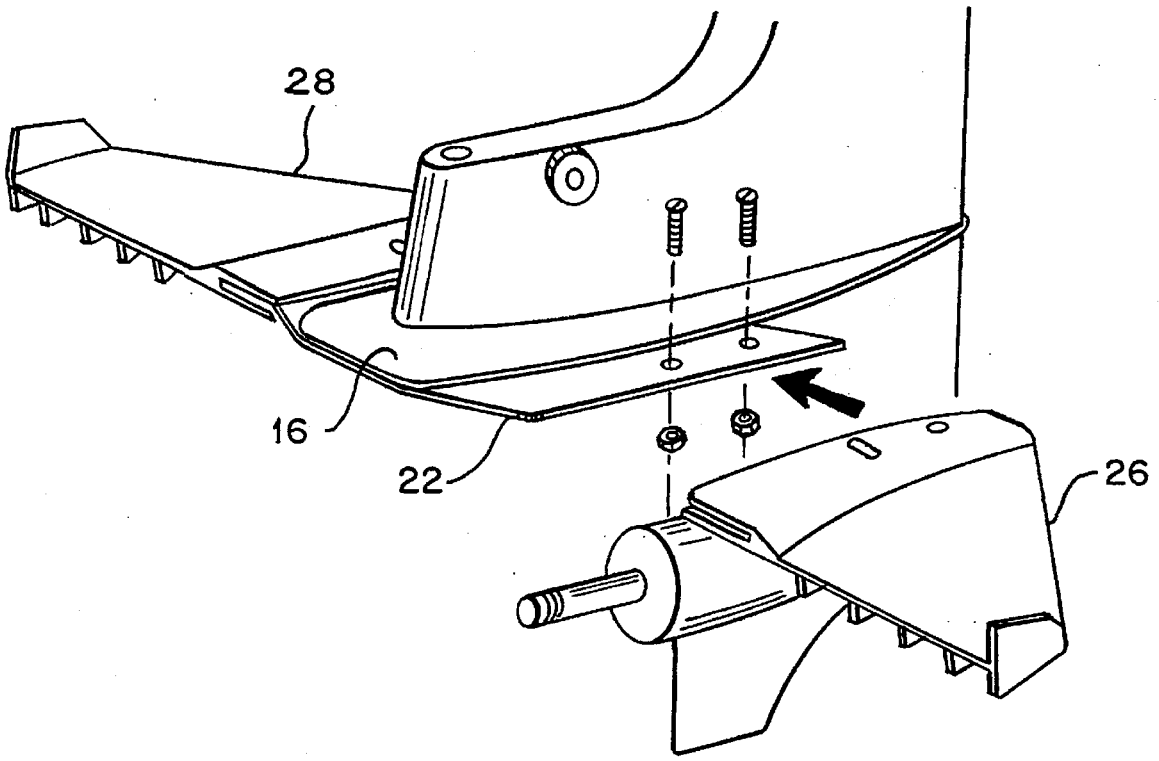
Figure 8E:
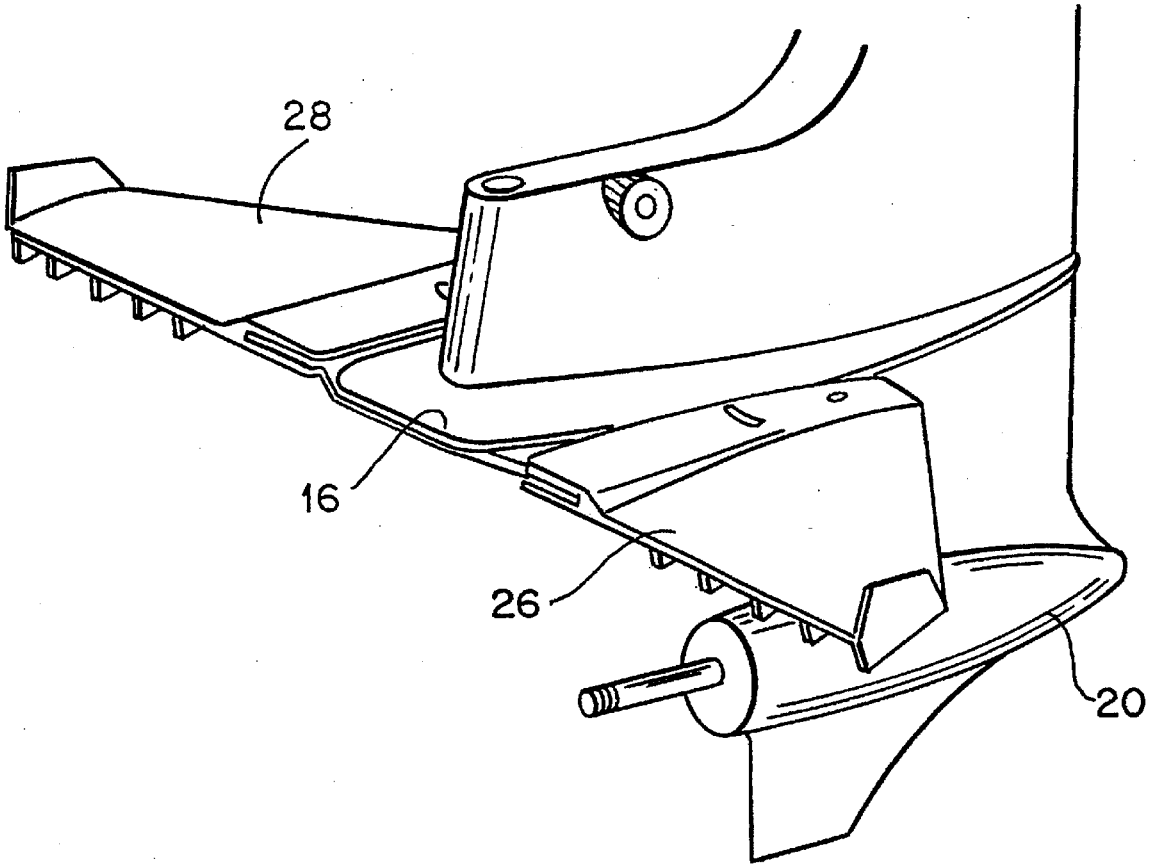

The installation of the hydrofoil assembly begins with the removal of the bolt 42 which secures the counter-rotation tab 18 to the lower leg of the engine housing, as shown in FIG. 8A. A hex key 43 may be employed for this procedure. The tab is then replaced by the plate adaptor 24, as shown in FIG. 8B. The adaptor is secured to the housing using the same bolt 42 which held the tab in place. Once the tab is mounted to the engine housing, the mounting plate 22 is secured to the tab by inserting the bolts 48 through two of the openings 34 along the center line of the plate and threadably securing them within the holes 46 of the adaptor. This step is shown in FIG. 8C. Finally, the hydrofoils 26,28 are secured to the opposing edge portions 30,32 of the mounting plate as described above, and as shown in FIG. 8D. The angle of the hydrofoils is adjusted, and the nut and bolt assemblies 58 are tightened. FIG. 8E illustrates the fully mounted assembly.

As discussed above, the rudders 50 of the hydrofoils 26,28 provide sufficient compensation for propeller torque and eliminate the need for the fin which extends from the counter-rotation tab. The invention is, however, applicable to assemblies having hydrofoils which do not include such rudders. In the event such hydrofoils are used, the assembly 10 may also include a replacement fin assembly 70 having a pair of slotted openings 72. The slotted openings allow the assembly 70 to be mounted to the mounting plate in a plurality of rotational positions so that the fin 74 can compensate for propeller torque.

Hydrofoils which lack slotted mounting openings such as those 56 in the hydrofoils 26,28 may also be employed in accordance with the invention. In such event, the mounting plate may include such slotted openings. Alternatively, brackets having such slotted openings may be secured to the mounting plate, and the hydrofoils would be secured to the brackets. In either event, the hydrofoils would be positionable in a plurality of rotational orientations to enable the user to select the optimal positions for the vessel.

Figure 4:
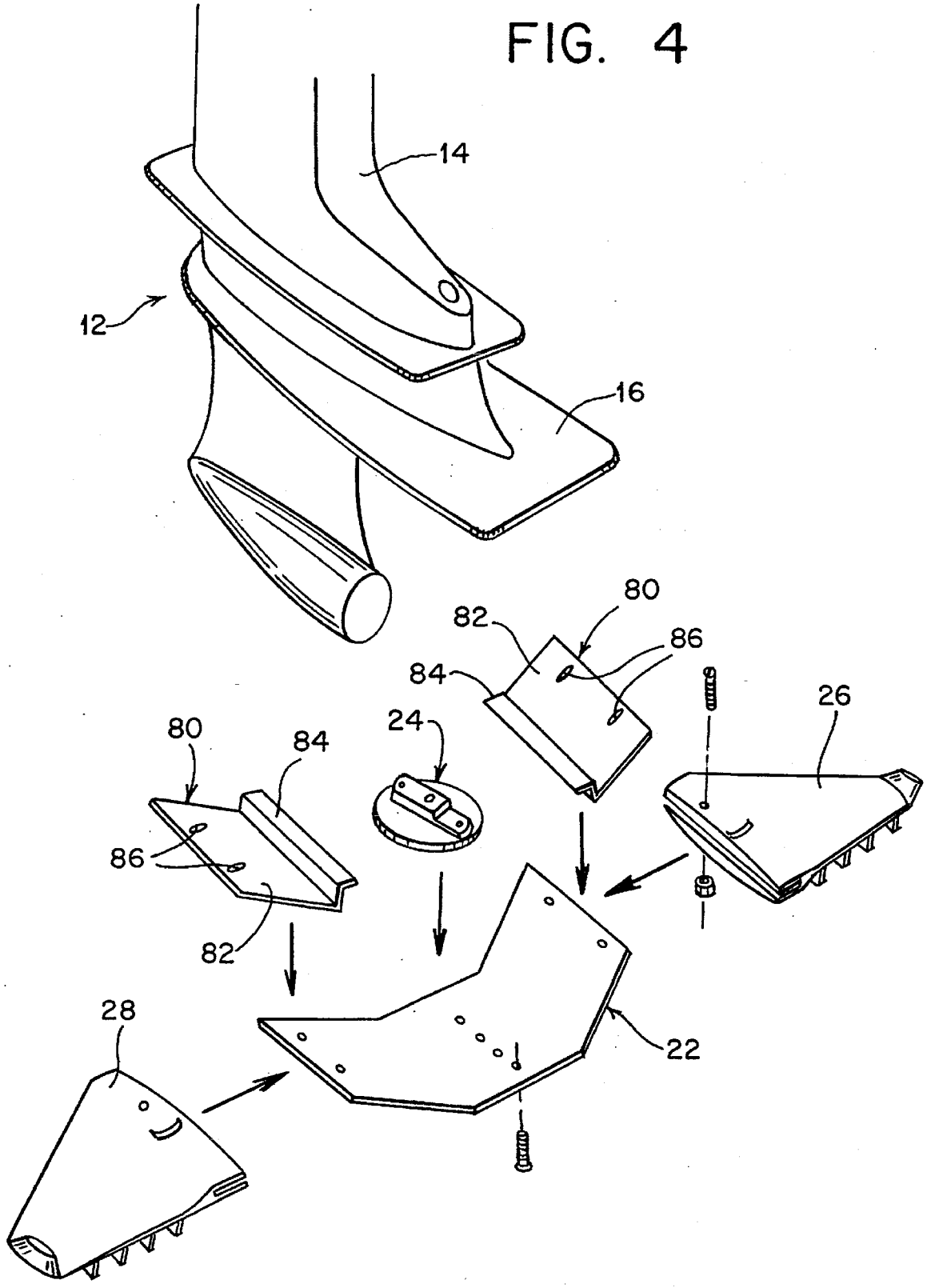
FIG. 4 is an exploded, perspective view of a second embodiment of the invention.
Figure 5:
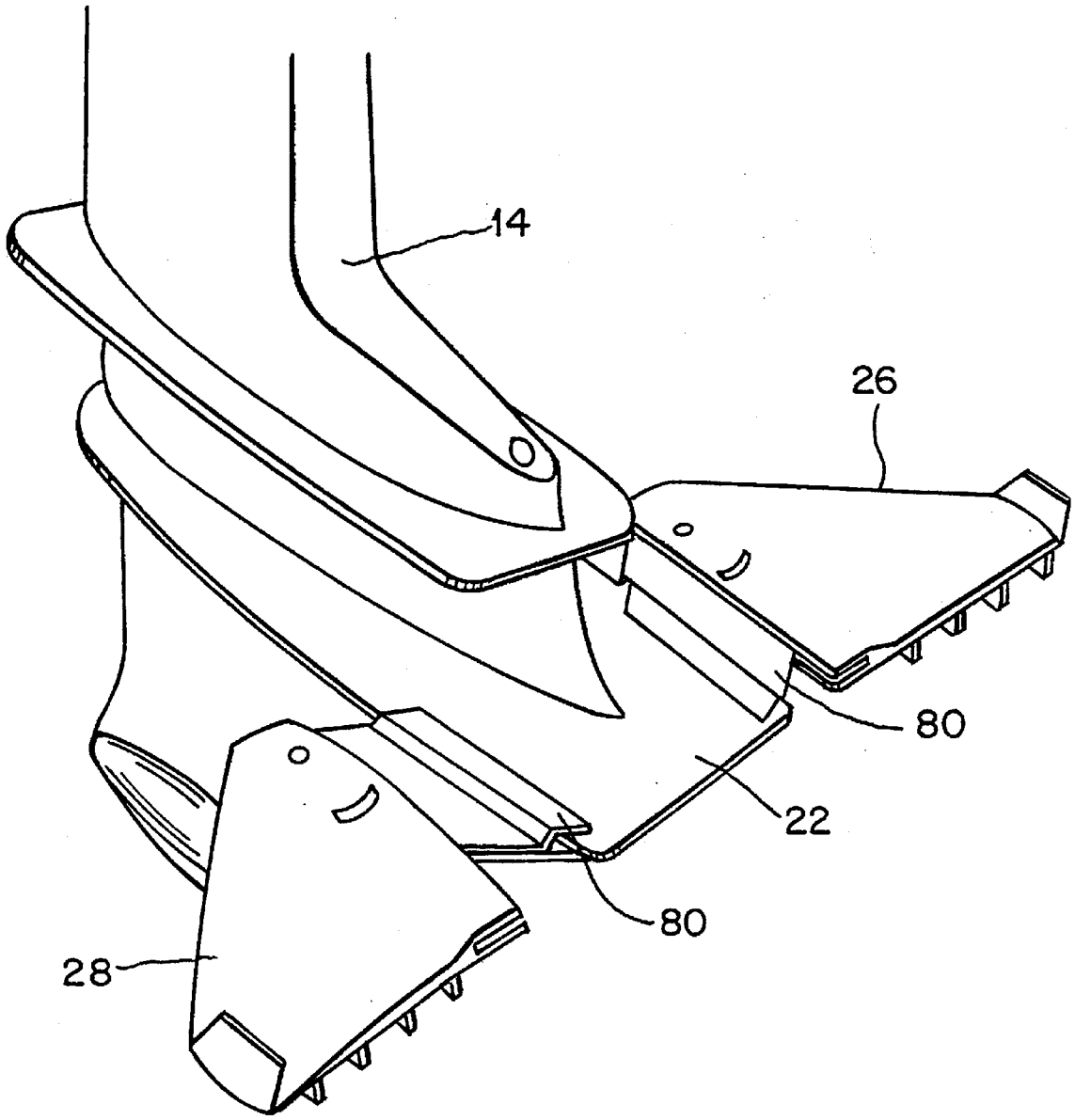
FIG. 5 is a top perspective view thereof.

Referring now to FIGS. 4–5, an alternative and preferred embodiment of the invention is disclosed. The hydrofoil assembly is substantially the same as that disclosed in FIGS. 1–3, and the same numerals are employed to identify the same structures. A pair of reinforcing brackets 80 are employed, however, for reinforcing the mounting plate 22 and relieving the strain on the center bolt 42. Each bracket 80 includes a substantially planar body 82 and a raised step 84. A pair of openings 86 are provided in the body portion of each bracket. These openings may be elongate as shown, and are aligned with the corresponding openings in the edge portions of the hydrofoils 26,28 and mounting plate. One or more additional openings may be provided in both the mounting plate and brackets for coupling purposes. Such openings may be necessary for relatively large mounting plates. The brackets 80 may be made from stainless steel.

The hydrofoil assembly shown in FIGS. 4–5 is mounted to the lower part of the engine in substantially the same manner as that described above with respect to FIGS. 8A–8E. Once the mounting plate 22 is secured to the adaptor 24, the brackets 80 are positioned such that the openings 86 are aligned with those in the edge portions of the mounting plate and the edges of the anticavitation plate 16 are positioned within the slots defined between the steps 84 and the upper surface of the mounting plate. The hydrofoils 26,28 are then mounted to the edge portions of the brackets and mounting plate. The bolts 58 are passed through the aligned openings in the hydrofoils, mounting plate and brackets, and secure these components to each other as shown in FIG. 5.

Figure 6:
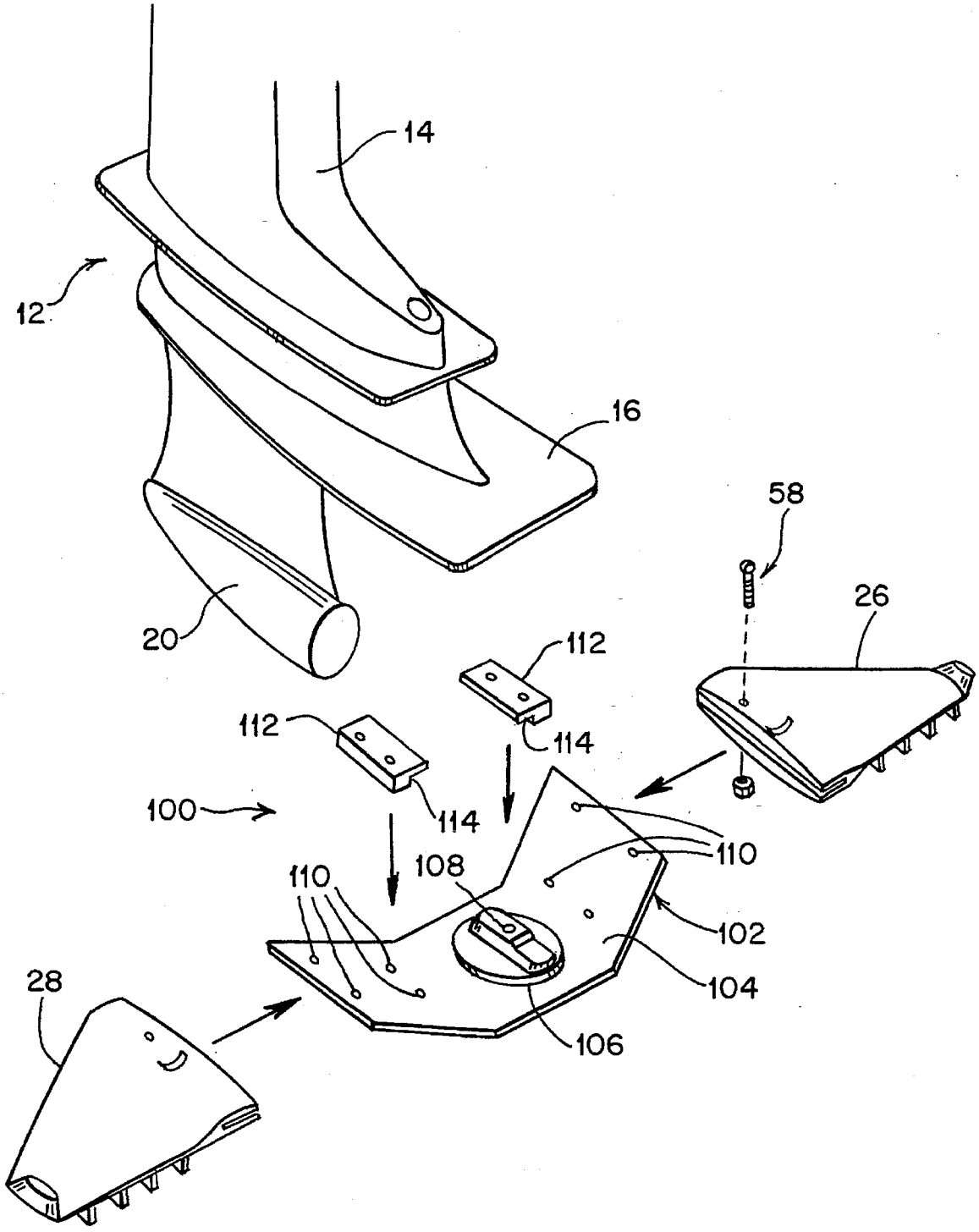
FIG. 6 is an exploded, perspective view of a third embodiment of the invention.
Figure 7:
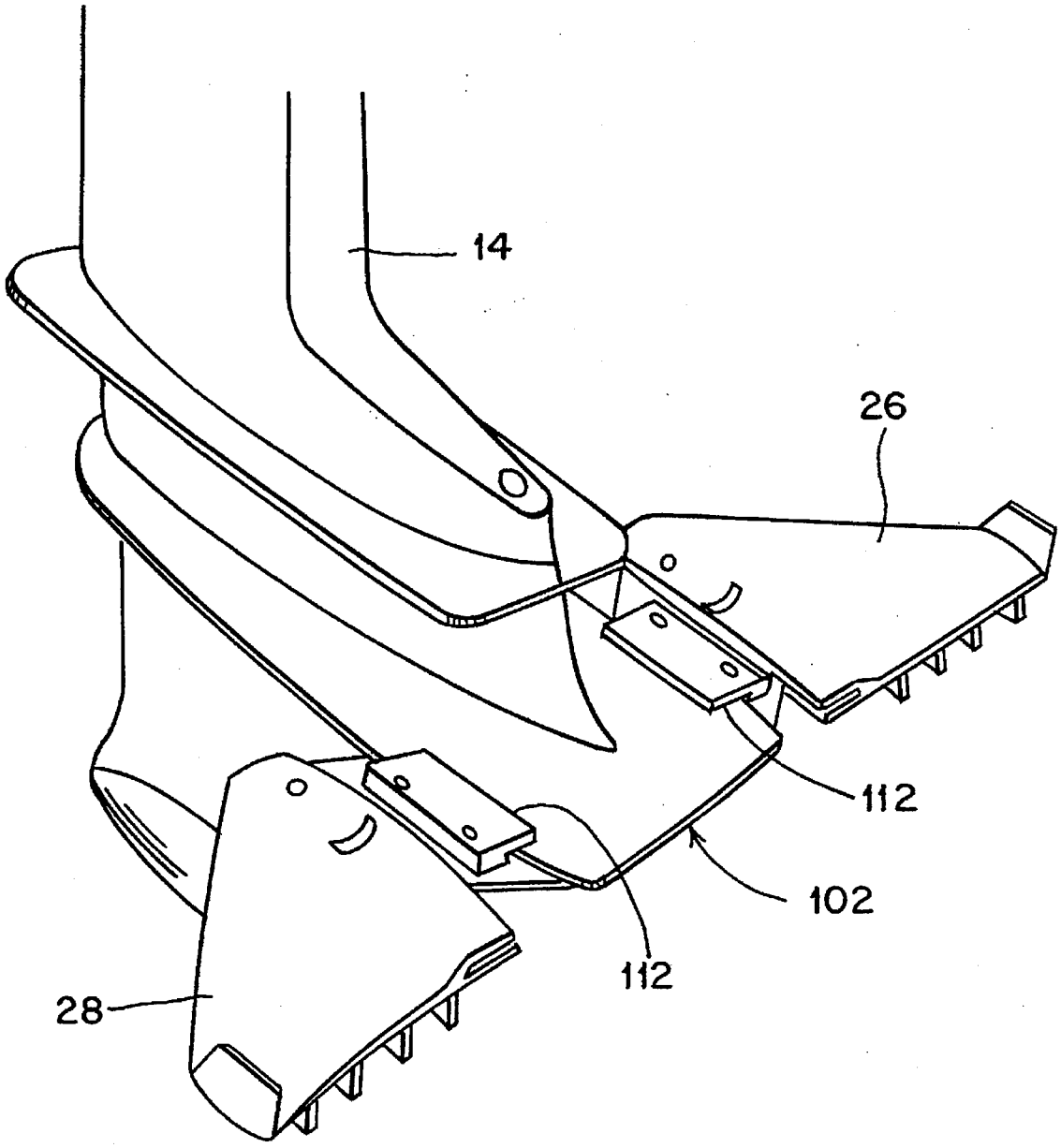
FIG. 7 is a top perspective view thereof.

A third embodiment of the invention is shown in FIGS. 6–7. The hydrofoil assembly 100 in this embodiment includes a pair of hydrofoils 26,28 as described above. The mounting plate and adaptor are, however, integrally constructed as a plate/adaptor member 102. The plate portion 104 of the member 102 has substantially the same configuration as that described above. As the member is preferably molded from a semi-rigid polymeric material such as polypropylene, the plate portion is thicker than if made from stainless steel. A thickness of about 0.25 inches is contemplated, but may vary depending upon the vessel with which it is to be used. It should be appreciated, however, that the plate/adaptor member 102 could be made from stainless steel.

The adaptor portion 106 of the member 102 includes a threaded opening 108 for receiving the center bolt 42 (see FIG. 1) which ordinarily secures the counter-rotation tab to the engine. The plate portion 104 includes four pairs of openings 110. Two pairs are used for securing the hydrofoils 26,28. The other two pairs are used for securing a pair of reinforcing brackets 112 by nut and bolt assemblies or the like. Each bracket 112 includes a notch 114 which receives an edge of the anticavitation plate. The bottom surfaces of the notches preferably engage the top surface of the anticavitation plate when the hydrofoil assembly is secured to the engine housing. Though not preferred, the reinforcing brackets can be integral with the mounting plate.

The hydrofoil assembly 100 is secured to the lower portion of the engine housing using the same basic steps described above with respect to the first two embodiments. As the adaptor and mounting plate are an integral unit, it is unnecessary to couple them prior to or during installation. Once the plate/adaptor member 102 is secured to the engine housing by the center bolt, the brackets 112 are coupled thereto. The hydrofoils are then secured to the edge portions of the plate/adaptor member 102 at selected orientations.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A hydrofoil assembly for mounting to the lower leg of a marine outboard engine, the lower leg including a counter-rotation tab and an anticavitation plate, comprising:

a mounting plate having a pair of opposing edge portions;

an adaptor mountable to the lower leg of the marine outboard engine in place of the counter-rotation tab;

means for securing said adaptor to said mounting plate;

first and second reinforcing brackets for reinforcing said mounting plate;

means for securing said reinforcing brackets to said mounting plate such that a slot is defined between each reinforcing bracket and said mounting plate for reception of an edge of the anticavitation plate;

first and second hydrofoils, and means for securing said first and second hydrofoils to said opposing edge portions of said mounting plate.

2. An assembly as described in claim 1, wherein each of said hydrofoils includes a downwardly extending rudder, and said means for securing said first and second hydrofoils include means for pivotably securing said first and second hydrofoils to said mounting plate.

3. An assembly as described in claim 2, wherein said mounting plate includes a leading edge including a pair of forwardly extending end portions defining an obtuse angle with respect to each other.

4. An assembly as described in claim 1, wherein said mounting plate includes a leading edge defining a recess for accommodating a motor post of the engine.

5. An assembly as described in claim 4, wherein said means for securing said adaptor to said mounting plate include means for positioning said adaptor in more than one location with respect to said leading edge.

6. An assembly as described in claim 1, wherein each of said edge portions of said mounting plate includes a plurality of openings.

7. An assembly as described in claim 1, wherein said adaptor includes a threaded opening therein for receiving a bolt.

8. An assembly for mounting a pair of hydrofoils to the lower leg of a marine outboard engine, the lower leg including a counter-rotation tab and an anticavitation plate, comprising:

a mounting plate having a pair of opposing edge portions, each of said edge portions including a plurality of openings;

first and second reinforcing brackets for reinforcing said mounting plate;

means for securing said reinforcing brackets to said mounting plate such that a slot is defined between each reinforcing bracket and said mounting plate for reception of an edge of the anticavitation plate;

an adaptor mountable to the lower leg of the marine outboard engine in place of the counter-rotation tab, said adaptor including a threaded opening for receiving a bolt, and means for securing said mounting plate to said adaptor.

9. An assembly as described in claim 8, wherein said mounting plate includes a leading edge defining a recess for accommodating a motor post of the engine.

10. An assembly as described in claim 8, wherein said mounting plate is substantially planar.

11. An assembly as described in claim 10 further including a fin assembly and means for securing said fin assembly to said mounting plate in a plurality of rotational positions.

12. An assembly as described in claim 8, wherein said adaptor is integral with said mounting plate.

13. A method for mounting hydrofoils to a marine outboard engine of the type having a lower leg including a counter-rotation tab and an anticavitation plate, comprising:

providing a mounting plate having a pair of opposing edge portions, an adaptor, and first and second hydrofoils;

removing said counter-rotation tab from said lower leg of said engine;

securing said adaptor and said mounting plate to said lower leg of said engine such that said adaptor replaces said counter-rotation tab and said mounting plate is secured to said adaptor, and mounting said first and second hydrofoils, respectively, to said opposing edge portions of said mounting plate.

14. A method as described in claim 13, including the step of securing said mounting plate and said adaptor to said lower leg as an integral unit.

15. A method as described in claim 13, including the steps of first securing said adaptor to said lower leg and then securing said mounting plate to said adaptor.

16. A method as described in claim 13, including the steps of providing a pair of reinforcing brackets, and securing said reinforcing brackets to said mounting plate such that a portion of each said mounting bracket extends over said anticavitation plate.

17. A method as described in claim 13, wherein said counter-rotation tab is secured to said engine by a bolt, including the steps of removing said bolt to remove said counter-rotation tab and securing said adaptor to said lower leg of said engine by threadably engaging said adaptor with said bolt.

* * * * *